US006325892B1

(12) United States Patent
Ni et al.

(10) Patent No.: US 6,325,892 B1
(45) **Date of Patent: *Dec. 4, 2001**

(54) METHOD OF DELIGNIFYING SULPHITE PULP WITH OXYGEN AND BOROHYDRIDE

(75) Inventors: Yonghao Ni, Fredericton; Adriaan R. P. Van Heiningen, Mouth of Keswick; Guo Jun Kang, Fredericton; Anastasios Skothos, Montreal, all of (CA)

(73) Assignee: University of New Brunswick (CA)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/158,498

(22) Filed: Sep. 23, 1998

(51) Int. Cl.[7] ..... D21C 9/147

(52) U.S. Cl. ..... 162/65; 162/80; 162/83; 162/90

(58) Field of Search ..... 162/80, 90, 65, 162/83

(56) References Cited

U.S. PATENT DOCUMENTS

| | | | | |
|---|---|---|---|---|
| 3,759,783 | * | 9/1973 | Samuelson et al. | 162/65 |
| 4,248,662 | * | 2/1981 | Wallick | 162/65 |
| 4,248,663 | | 2/1981 | Kubes et al. | 162/72 |
| 4,384,921 | | 5/1983 | Pihlajamaki et al. | 162/72 |
| 4,574,032 | | 3/1986 | Ringley | 162/38 |
| 4,915,785 | | 4/1990 | Siminoski et al. | 162/78 |
| 4,938,842 | | 7/1990 | Whiting et al. | 162/78 |
| 5,139,617 | | 8/1992 | Tikka et al. | 162/72 |
| 5,391,261 | | 2/1995 | Van Den Bergh | 162/4 |
| 5,449,436 | | 9/1995 | Bourson et al. | 162/6 |
| 5,464,501 | | 11/1995 | Kogan et al. | 162/6 |
| 5,534,115 | * | 7/1996 | Hoyos et al. | 162/80 |
| 5,611,889 | * | 3/1997 | Leary et al. | 162/80 |

FOREIGN PATENT DOCUMENTS

| | | | | |
|---|---|---|---|---|
| 611510 | * | 12/1960 | (CA) | 162/80 |
| 2157154 | | 3/1996 | (CA) | D21C/9/10 |
| 38 09 332 | | 10/1989 | (DE) | D21C/9/16 |
| 2692917 | | 12/1993 | (DE) | D21C/9/153 |
| 0010451 | | 4/1980 | (EP) | D21C/1/00 |
| 0262988 | | 4/1988 | (EP) | D21C/3/02 |
| 2692917 | | 12/1993 | (FR) . | |
| 96053654 | | 2/1996 | (WO) | D21C/9/10 |

OTHER PUBLICATIONS

Michell et al, "Bleaching and Yellowing of Eucalyptus Chemimechanical Pulps. Diffuse Reflectance Spectra of Oxygen Bleached Pulps", Appita, vol. 44, No. 5, Sep. 1991.*

Chirat et al., Paperi Ja Puu, 1994, 76 (6–7), 417–422.

Beharic S., Papir 20, 1992, 20 (3–4), 11–15 (English Abstract Only).

Bokstrom et al., Pulp & Paper Canada, 1991, 92(11) 38–43.

1997 Pulping Conference—Tappi Proceedings, Oct. 19, 1997.

* cited by examiner

*Primary Examiner*—Steve Alvo
(74) *Attorney, Agent, or Firm*—Katten Muchin Zavis

(57) ABSTRACT

A single stage method delignification process for pulps, preferably sulphite pulps. The improvement to conventional oxygen delignification process comprises in situ addition of a reducing agent substantially non-reactive with oxygen. The end result is a pulp having enhanced strength properties and higher viscosity. Sodium borohydride is the preferred reducing agent, and MgO is the preferred alkali source. Similar results can be obtained with a two-stage oxygen delignification wherein the pulp is treated with the reducing agent in the first stage, and then washed and pressed conventionnally before proceeding with the oxygen delignification in a second stage.

6 Claims, 1 Drawing Sheet

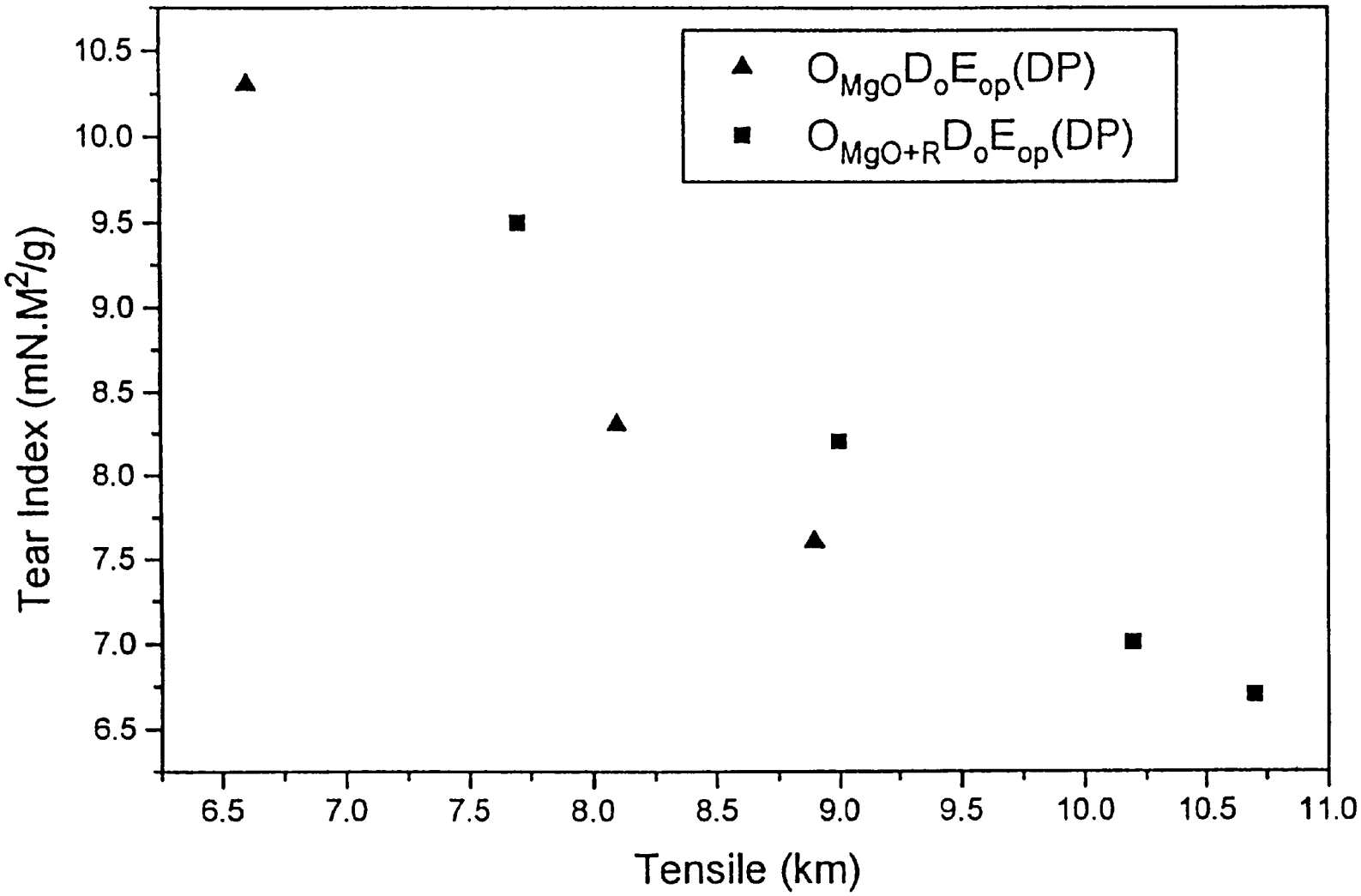
$O_{MgO}D_oE_{op}$(DP)
$O_{MgO+R}D_oE_{op}$(DP)
Tear Index (mN.M²/g)
10.5
10.0
9.5
9.0
8.5
8.0
7.5
7.0
6.5
Tensile (km)
6.5
7.0
7.5
8.0
8.5
9.0
9.5
10.0
10.5
11.0

METHOD OF DELIGNIFYING SULPHITE PULP WITH OXYGEN AND BOROHYDRIDE

FIELD OF THE INVENTION

The present invention is concerned with a single stage process for decreasing carbohydrate degradation of sulphite pulps during the $O_{MgO}$ process by the addition of a catalytic amount of sodium borohydride in situ to provide a pulp with enhanced strength properties and increased viscosity.

BACKGROUND OF THE INVENTION

Because of incensing environmental concerns worldwide, pulp and paper mills discharge effluents are constantly under scrutiny to ensure that environmental regulations are followed. Because of the high costs involved in the treatment of effluents before their release in the environment, a great deal of research is directed to the modification of current pulp and paper production processes. The research concentrates its efforts in replacing toxic reagents with more environmentally friendly products. A further benefit sought with such changes is that effluents will hopefully require fewer costly conditioning treatments before their release in the environment.

In the various processes proposed in the literature, the oxygen delignification technology is one of the available options towards this direction. Conventionally, oxygen delignification technology uses sodium hydroxide as the alkaline source and the resulting effluent produced can therefore be incorporated into the chemical recovery system of the process for preparing kraft pulps because the same reagent, namely sodium hydroxide, is used, and therefore, there is no reagent interference. On the other hand, the effluent from the sodium hydroxide-based oxygen delignification process (referred to as the $O_{NaOH}$ technology herein) cannot be sent to the recovery system of the magnesium-based sulphite process because, obviously, the sodium salts are not compatible with the magnesium-based sulphite recovery process. Several publications have therefore concluded that magnesium oxide-based oxygen delignification technology, referred to as $O_{MgO}$ herein, is preferred for magnesium-based sulphite pulping processes. (see for example Bokstrom et al., *Pulp and Paper Canada,* 1992, 92 (11), 38; and Luo et al., *Tappi Journal,* 1992, 75 (6), 183).

Sodium hydroxide has been replaced lately as a base with magnesium oxide (MgO) or magnesium hydroxide ($Mg(OH)_2$) for the oxygen delignification of sulphite pulps. However, because of the low alkalinity of MgO or $Mg(OH)_2$, the temperature of delignification with MgO or $Mg(OH)_2$ must be about 30° C. higher than for the same process using NaOH as the delignification agent (see Luo et al., supra). Alternatively, the delignification rate can be increased in the $O_{MgO}$ process by the addition of a very limited amount of NaOH, since small concentrations of sodium salts can be tolerated in the recovery system of magnesium-based sulphite process. However, the risk of contamination in the long run is such that this alternative does not represent a desirable selection.

Changing the alkali source in the oxygen delignification process from sodium hydroxide to magnesium oxide or magnesium hydroxide, as taught by Bokstrom et al. supra, decreases the selectivity of lignin to carbohydrate degradation. Moreover, the strength properties also decrease, as illustrated in the relationship between tear index versus tensile index of FIG. 6, by Luo et al. supra. For a given type of wood chips used as starting material, it is well known that sulphite pulps usually have strength properties inferior to that of kraft pulp, and a further decrease in strength properties during the delignification process is therefore unacceptable for commercial operations.

It is known that a post treatment stage with sodium borohydride on an oxidized pulp, such as ozone delignified pulp, leads to increased pulp viscosity. For example, it was reported by Chirat et al. in Holzforschung, 1994, 48 Suppl. 133, that a reduction treatment stage with 0.1% sodium borohydride increases the viscosity of ozone bleached pulp from $DP_v$ of 710 to 920. The chemistry of sodium borohydride reduction is well understood: carbonyl groups present in carbohydrates are reduced to alcohol functionalities (B. Browning, Methods of Wood Chemistry, Vol. 2, P. 685, Interscience Publishers).

In addition, it is proposed by S. Beharic in Papir Dec. 20, 1992, 3(4) pp. 11–15 to add sodium borohydride either before ozone bleaching or after peroxide bleaching to limit the reduction in pulp viscosity. Again, two stages are involved for this pulp treatment.

Accordingly, there is therefore a great need to develop an oxygen delignification process providing pulps with enhanced strength properties and increased viscosity. Preferably, a single stage bleaching process should be considered, wherein a reducing agent would be added in situ. This would represent a significant advance in pulp bleaching, and bring significant benefits to the industry, because the elimination of one treatment stage of pulp represents a significant capital cost reduction.

SUMMARY OF THE INVENTION

In accordance with the present invention, there is now provided an improvement to oxygen delignification process of pulps. More specifically, the present invention comprises the conventional steps of oxygen delignification of pulp, namely treating a pulp slurry in a reactor under oxygen overpressure in the presence of an alkali source, over a period of time sufficient to complete delignification of the pulp, with the improvement comprising adding in situ an effective amount of a reducing agent substantially non-reactive with the oxygen, to provide delignified pulps with enhanced strength properties and increased viscosity.

The present oxygen delignification process is particularly advantageous for sulphite pulps when MgO or $Mg(OH)_2$ are used as the alkali source. Other possible alkali sources include $Ca(OH)_2$, $NH_4OH$, NaOH and the like. Reducing agents include sodium borohydride, sodium hydrosulphite and the like, with sodium borohydride being the most preferred.

In another aspect of the present invention, the process comprises a first stage wherein the pulp is treated with the reducing agent, and then washed and pressed if necessary, and a second conventional oxygen delignification stage. Although good results are obtained with the two-stage process, the single stage process is much preferred because of the elimination of washing and pressing operations required after treatment with the reducing agent in the two-stage process.

IN THE DRAWINGS

FIG. 1 illustrates the strength properties of $O_{MgO+R}D_OE_{op}$ (DP) bleached pulp and those of $O_{MgO}D_OE_{op}$(DP) bleached pulp.

DETAILED DESCRIPTION OF THE INVENTION

It is an object of the present invention to provide a single or two-stage oxygen delignification process of pulp which can minimize the carbohydrate degradation and thus enhance the strength properties of the pulp, as well as the viscosity. The present single stage process is most advantageous for MgO delignification of sulphite pulps.

It is also an object of the present invention to provide a two-stage oxygen delignification process of pulps which can minimize the carbohydrate degradation and thus enhance the strength properties of the pulp, as well as the viscosity. As for the single stage process, the two-stage process is also most advantageous for MgO delignification of sulphite pulps.

The present invention comprises the use of a small amount of a reducing agent, most preferably sodium borohydride, either before or during the oxygen delignification process. Preferred alkali source, as mentioned above, are MgO, $Mg(OH)_2$ and the like. The key feature of the unexpected results obtained with the present single stage process is that the activity of the reducing agent is substantially not affected by the overpressure of oxygen in the reaction media. The reducing agent and the alkali source may be added simultaneously, or the reducing agent is added to the pulp shortly before the alkali source. The reverse order of addition of reagents is also possible. Preferred experimental conditions for carrying the present single stage process are as follows: pH from 8 to 13; temperature of from 80 to 140° C.; an oxygen overpressure of from 30 to 200 psi; a pulp consistency of from 1% to 50%; an addition of from 0.01% to 10% of sodium borohydride, an addition of MgO of from 0.2 to 10%; and a reaction time of from 0.1 to 4 hours. Most preferred conditions are: 127° C.; 100 psi $O_2$ pressure; 10% pulp consistency; an addition of 0.1% of sodium borohydride, an addition of 2% MgO and a reaction time of 2 hours. It has been unexpectedly found that the addition of sodium borohydride in conventional magnesium oxide-based oxygen delignification process of sulphite pulp results in the production of pulps having an increased viscosity and improved strength properties when compared to pulp prepared in the same manner but without the addition of sodium borohydride.

In the case of a two-stage process, the experimental conditions for the oxygen delignification stage are the same as those above. With respect to the first stage, preferred conditions are as follows: 0.1% to 10% (by weight on pulp) of reducing agent is mixed with a pulp suspension at a pH of from 5 to 13 and maintained at a temperature of 20 to 100° C. for a period of time of a few seconds up to 2 hours. The pulp is then washed conventionnally, for example with water, and pressed if necessary, to collect the pulp fibers which will be treated under the above oxygen delignification stage. It has been unexpectedly found that the treatment of sulphite pulp with sodium borohydride before treating the pulp with a conventional magnesium oxide-based oxygen delignification process results in the production of pulps having an increased viscosity and improved strength properties when compared to pulp prepared in the same manner but without the addition of sodium borohydride. Results hereinbelow will also show that if the pulp is first treated under oxygen delignification conditions and then with a reducing agent, the properties of the pulp are not as good as the single stage treated pulp, or two stage treated pulp wherein the treatment with reducing agent occurred before oxygen delignification.

The expression "enhanced stength properties" should be interpreted as meaning that the strength properties of the pulp are at least comparable, and generally better than those of pulp obtained from a bleaching sequence using chlorine or chlorine dioxide without oxygen delignification. Further, "increased viscosity" means that the viscosity is at least equivalent to that of eastern Canadian softwood sulphite pulp after conventional $O_{MgO}$ delignification, i.e., typically about 25 mPa·s to about 45 mPa·s.

The following examples are provided for illustrating the present invention and should not be construed as limiting its scope.

EXAMPLE 1

40 g of eastern softwood sulphite pulp (kappa no. 26.0, pulp viscosity 40.1 mPa·s determined on the chlorite delignified pulp) in a pulp consistency of 28.5% is weighed into a beaker containing about 360 ml of water, resulting in a pulp consistency of about 10% and then disintegrated in a conventional manner, for example by a blender to be free from fiber bundles. 0.5% sodium borohydride (by weight on pulp) is rapidly mixed with the pulp slurry prepared above (~400 ml). The slurry has a pulp consistency of 10% and contains about 2% MgO (by weight on pulp) and 0.2% $MgSO_4$ (by weight on pulp). The pulp slurry is subsequently transferred to a Parr pressure reactor preheated at a temperature of about 100° C. The $O_{MgO+R}$ process, that is, conventional $O_{MgO}$ technology with the addition of sodium borohydride in situ, is performed at about 127° C. and 100 psi for 2 hours in a single stage. The resulting pulp with a kappa number of 14.0 is then bleached to full brightness (90% ISO) in accordance with the conventional $D_OE_{op}$ (DP) wherein $D_O$ stands for a chlorine dioxide stage;

$E_{op}$ represents a peroxide reinforced oxidative stage; and (DP) means that no washing is performed between chlorine dioxide treatment and peroxide treatment sequence.

The detailed conditions of each stage in the $D_OE_{op}$ (DP) sequence is provided in Table 1 below. The tear-tensile beating curve of the $O_{MgO+R}$ $D_OE_{op}$ (DP) bleached pulp is shown in FIG. 1.

TABLE 1

Detailed Conditions of Each Stage in the $D_oE_{op}$(DP) Stage

| | | | (DP) | |
|---|---|---|---|---|
| | $D_o$ | $E_{op}$ | D | P |
| Consistency (%) | 3.5 | 10 | 11.5 | 10 |
| Time (min) | 12 | 30 | 145 | 70 |
| Temperature (° C.) | 60 | 70 | 72 | 80 |
| $O_2$ pressure (psi) | — | 40 for 4 min. | — | — |
| Chemicals (% on pulp) | Kappa: 0.14 $ClO_2$: 0.75 | $H_2O_2$: 0.8 NaOH: 1.8 | $ClO_2$:0.4 | $H_2O_2$: 0.5 NaOH: 0.7 |

EXAMPLE 2

This experiment is provided to illustrate the properties of a pulp obtained in experimental conditions similar to those of Example 1 without adding sodium borohydride during the conventional $O_{MgO}$ process. As it will be seen, the strength properties of the $O_{MgO}$ $D_OE_{op}$(DP) bleached pulp are inferior to those of the $O_{MgO+R}$ $D_OE_{op}$(DP) bleached pulp.

The eastern softwood sulphite pulp (kappa no. 26.0, pulp viscosity 40.1 mPa·s determined on the chlorite delignified pulp) used in Example 1 is also used in the present example. 2% MgO (b y weight on pulp) and 0.2% $MgSO_4$ are mixed with a pulp suspension containing 40 g pulp. The pulp slurry is then transferred to a Parr pressure reactor preheated at a temperature of about 100° C. The $O_{MgO}$ delignificafion process is performed at a temperature of 127° C. with an oxygen overpressure of about 100 psi for 2 hrs. At the end of these 2 hours, the resulting pulp with a kappa number of 13.8 is then further bleached to a full brightness in accordance with the $D_oE_{op}$ (DP) sequence described above. The tear-tensile beating curve of the $O_{MgO}$ $D_o$ $E_{op}$ (DP) bleached pulp is also illustrated in FIG. 1, which shows that the strength properties of $O_{MgO+R}D_OE_{op}$(DP) bleached pulp are significantly improved over those of $O_{MgO}D_OE_{op}$ (DP) bleached pulp.

EXAMPLE 3

This example is provided to show the effect of sodium borohydride concentration on the pulp viscosity after the $O_{MgO+R}$ delignification process. An Eastern softwood sulphite pulp with a kappa no. of 25.2 and viscosity of 43.1 mPa·s determined on the chlorite delignified pulp is used. The sodium borohydride concentration varies from 0 to 0.05 to 0.1 to 0.2% (by weight on pulp). The required amount of $NaBH_4$ is rapidly mixed with a pulp slurry having a pulp consistency of 10% and containing about 2% MgO and about 0.2% $MgSO_4$. The subsequent procedures are identical to those described in Example 1. The kappa number, viscosity and brightness of the $O_{MgO+R}$ delignified pulps at various $NaBH_4$ concentrations are given in Table 2.

TABLE 2

Effect of the sodium borohydride concentration on pulp viscosity during the $O_{MgO}$ process

| Sodium borohydride concentration (% on pulp) | Kappa number | Pulp viscosity (mPa.s) | Brightness (% ISO) |
|---|---|---|---|
| 0 | 12.8 | 27.8 | 57.7 |
| 0.05 | 13.9 | 39.1 | 59.6 |
| 0.1 | 12.4 | 43.0 | 62.5 |
| 0.2 | 14.6 | 43.0 | 60.9 |

The above results clearly show that the pulp viscosity is significantly improved when sodium borohydride is present during the $O_{MgO}$ delignification stage. In addition, the brightness of the $O_{MgO+R}$ delignified is always higher than that of the $O_{MgO}$ treated pulp under otherwise the same condition. Furthermore, the data show that a sodium borohydride concentration as low as 0.05% is sufficient to achieve the desired beneficial effect.

EXAMPLE 4

This example is provided to show that a two-stage $RO_{MgO}$, i.e., treatment with sodium borohydride in a first stage followed by water washing and then conventional $O_{MgO}$ in a second stage, can produce acceptable delignified pulp with properties inferior to those of the $O_{MgO+R}$ treated pulp.

The same Eastern softwood sulphite pulp as that used in Example 3 is used in this example. 0.1% $NaBH_4$ (by weight on pulp) is mixed with a pulp suspension of pH 9.5 and containing 20 g pulp in a polyethylene bag. Sodium hydroxide is used to increase the pH. The polyethylene bag is then thermostated at 50° C. At the completion of 30 minutes, the pulp slurry is thoroughly washed with purified water and the pulp fibres are collected for the subsequent $O_{MgO}$ treatment under the conditions of 10% pulp consistency, 2% MgO, 0.2% $MgSO_4$, 100 psi, 127° C., 2 h and without the addition of sodium borohydride. The kappa number, viscosity and pulp brightness of the resulting pulp are compared to those of $O_{MgO}$ treated and $O_{MgO+R}$ treated pulps in Table 3.

TABLE 3

Kappa number, viscosity and brightness obtained for pulp treated under different processes

| Technique | Kappa no. | Viscosity (mPa.s) | Brightness (% ISO) |
|---|---|---|---|
| $O_{MgO}$ | 12.8 | 27.8 | 57.7 |
| $O_{MgO+R}$ (0.1% $NaBH_4$) | 12.4 | 43.0 | 62.5 |
| $RO_{MgO}$ (0.1% $NaBH_4$) | 13.8 | 39.5 | 59.9 |

Table 3 shows that the results obtained for a pulp treated under the $RO_{MgO}$ process are better than that treated under the $O_{MgO}$ process. However, the best results are obtained with a single stage $O_{MgO+R}$ process.

EXAMPLE 5

This example is provided to show that a reduction with sodium borohydride in a second stage after the $O_{MgO}$ treatment of the pulp in a first stage, i.e., a $O_{MgO}R$ sequence, also increases the pulp viscosity, but rather moderately. However, the viscosity of the $O_{MgO}R$ treated pulp is substantially lower than that of the single stage $O_{MgO+R}$ treated pulp according to the present invention.

The same Eastern softwood sulphite pulp as in Example 3 is used. 20 g of pulp is subjected to a first stage $O_{MgO}$ process under the conditions of 10% pulp consistency, 2% MgO, 0.2% $MgSO_4$, 100 psi, 127° C., 2h, without adding sodium borohydride. Subsequently, the $O_{MgO}$ delignified pulp is treated in a second stage with 0.1% sodium borohydride at pH 9.5, 10% pulp consistency and 50° C. for 30 minutes. The kappa number, the viscosity and the pulp brightness of the resulting pulp are compared to those of $O_{MgO}$ treated and $O_{MgO+R}$ treated pulps in Table 4.

TABLE 4

Kappa number, viscosity and brightness obtained for pulp treated under different processes

| Technique | Kappa no. | Viscosity (mPa.s) | Brightness (% ISO) |
|---|---|---|---|
| $O_{MgO}$ | 12.8 | 27.8 | 57.7 |
| $O_{MgO+R}$ (0.1% $NaBH_4$) | 12.4 | 43.0 | 62.5 |
| $O_{MgO}R$ (0.1% $NaBH_4$) | 12.0 | 32.9 | 63.3 |

The above results show that the viscosity of the $O_{MgO}R$ treated pulp is about 5 units higher than that of the $O_{MgO}$ treated pulp, however about 10 units lower than that of the $O_{MgO+R}$ treated pulps.

In view of the above results, it is apparent that the addition of a reducing agent in situ during the oxygen delignification process provides pulps with a higher viscosity and increased strength properties than that obtained during two-stage processes wherein the reducing agent is added either prior to or after the oxygen delignification process. The combination of a two-stage operation into a single stage one is beneficial not only because one stage has been removed, but also because the physical properties of the resulting pulp are significantly better. Nevertheless, good results are also obtained with a two stage process wherein the treatment with the reducing agent is carried out before the oxygen delignification stage. For obvious reasons, as mentioned above, a single stage process is most preferred.

While the invention has been described in connection with specific embodiments thereof, it will be understood that it is capable of further modifications and this application is intended to cover any variations, uses or adaptations of the invention following, in general, the principles of the invention and including such departures from the present disclosure as come within known or customary practice within the art to which the invention pertains, and as may be applied to the essential features hereinbefore set forth, and as follows in the scope of the appended claims.

What is claimed is:

1. A method for the oxygen delignification of sulphite chemical pulp, comprising the steps of:

treating a sulphite chemical pulp slurry in a reactor under oxygen overpressure at a pH of from substantially 8 to substantially 13 with an effective amount of an alkali source over a period of time sufficient to complete delignification of the sulphite chemical pulp wherein the alkali source is selected from the group consisting of MgO, $Mg(OH)_2$, NaOH, and mixtures thereof; and adding an effective amount of borohydride compound reducing agent which is substantially non-reactive with the oxygen to provide a sulphite chemical pulp with enhanced strength properties and increased viscosity, with the proviso that borohydride compound addition is carried out simultaneously with the oxygen delignification in the reactor, the borohydride compound reducing agent being added in situ during an oxygen stage.

2. A method according to claim 1 wherein the temperature of the reactor is maintained between substantially 80 to substantially 140° C. with the oxygen overpressure being from substantially 30 to substantially 200 psi, a pulp consistency of from substantially 1% to substantially 50%, and the period of time is from substantially 0.1 to substantially 4 hours.

3. A method according to claim 1 wherein substantially 0.01% to substantially 10%, by weight pulp, of reducing agent is added, and substantially 0.5% to substantially 10%, by weight pulp, of alkali source is added.

4. A method according to claim 1 wherein the borohydride compound comprises sodium borohydride.

5. A method for the oxygen delignification of sulphite chemical pulp, comprising the steps of:

treating a sulphite chemical pulp slurry in a reactor at a temperature of from substantially 80 to substantially 140° C. under an oxygen overpressure and a pH of from substantially 9 to substantially 12 with from substantially 0.5% to substantially 10%, by weight pulp of an alkali source over a period of time sufficient to complete delignification of the sulphite chemical pulp, wherein the alkali source is selected from the group consisting of MgO, $Mg(OH)_2$, NaOH, and mixtures thereof; and adding in the reactor simultaneously with the oxygen delignification from substantially 0.01% to substantially 10% by weight pulp of sodium borohydride reducing agent to improve the strength properties and increase the viscosity of the sulphite chemical pulp, the sodium borohydride reducing agent being added in situ during an oxygen stage.

6. A method according to claim 5 wherein the oxygen overpressure is from substantially 30 to substantially 200 psi and the pulp consistency is from substantially 1% to substantially 50%.

* * * * *